US007261111B2

(12) United States Patent
Marettek

(10) Patent No.: US 7,261,111 B2
(45) Date of Patent: Aug. 28, 2007

(54) DISHWASHER

(75) Inventor: Andreas Marettek, Sulzbach (DE)

(73) Assignee: Whirlpool Corporation, Benton Harbor, MI (US)

( * ) Notice: Subject to any disclaimer, the term of this patent is extended or adjusted under 35 U.S.C. 154(b) by 577 days.

(21) Appl. No.: 10/699,945

(22) Filed: Nov. 3, 2003

(65) Prior Publication Data

US 2004/0103925 A1 Jun. 3, 2004

(30) Foreign Application Priority Data

Nov. 28, 2002 (EP) ..... 02102663

(51) Int. Cl.
*B08B 3/00* (2006.01)

(52) U.S. Cl. ..... 134/111; 134/104.1; 134/58 D

(58) Field of Classification Search ..... 134/84, 134/111, 179, 200, 110, 104.4, 57 D, 58 D, 134/56 D
See application file for complete search history.

(56) References Cited

U.S. PATENT DOCUMENTS 4,347,861 A * 9/1982 Clearman et al. ..... 134/104.4
5,755,244 A * 5/1998 Sargeant et al. ..... 134/46
5,779,812 A * 7/1998 Thies et al. ..... 134/10

* cited by examiner

*Primary Examiner*—Michael Barr
*Assistant Examiner*—Jason Heckert
(74) *Attorney, Agent, or Firm*—Michael D. Lafren; John Morrison

(57) ABSTRACT

A dishwasher comprises a circulating pump, a washing tank provided with a substantially horizontal fine-mesh filter disposed in the path of the flow of water drawn in by the circulating pump, and spray means capable of directing downwardly at least one rotating water jet for filter cleaning purposes. Such fine-mesh filter presents an area below a circular pattern of the downwardly directed jet having a percentage of open area lower than the other portions of the filter.

17 Claims, 2 Drawing Sheets

DISHWASHER

BACKGROUND OF THE INVENTION

1. Field of the Invention

The present invention relates to a dishwasher comprising a circulating pump, a washing tank provided with a substantially horizontal filter disposed in the path of water flow drawn by the circulating pump and rotating spray means capable of directing downwardly at least one water jet.

2. Description of the Related Art

It is well known that the water jet directed downward be used mainly for cleaning automatically the above filter and any other coarse filter eventually associated to such horizontal filter. Another possible function of such water jet is to drive the rotation of the spray arm, even if for such function other water jets may be used. With the very efficient spray systems of modern dishwashers the speed of water jets is very high. If this is good for the water jets directed towards the crockery to be washed, it makes problem in its impingement against the fine-mesh horizontal filter placed below the spray arm, since such impingement creates many air bubbles which are driven in the chamber below the filter and sucked by the circulating pump. The presence of air bubbles in the water flow drawn by the circulating pump makes the working of this latter very unstable, since the rotational speed of the impeller can have quick increase and subsequent quick decrease. In order to avoid such unstable working (with consequent damages to the electric motor), it is known to have a high water level in the chamber so that the air bubbles have sufficient time to reach the surface without being sucked by the pump. This of course requires a higher amount of water per fill, which is not desirable in view of detergent concentration, impact on environment and energy needed for water heating.

A known solution is to provide a screen disposed between the spray arm and the substantially horizontal filter for intercepting the water jet above such filter. This solution has the drawback of requiring an additional component of the dishwashing machine, with higher overall cost and an uneasy removal of the spray arm and the filter for cleaning thereof. Moreover the interception of the downwardly directed water flow totally prevents the cleaning action on the fine-mesh filter.

In accordance with the invention there is provided a dishwasher in which the substantially horizontal filter presents a not uniform percentage of open area. Preferably an area of the filter below a circular pattern of the downwardly directed jet presents a percentage of open area lower than the percentage of open area of the remaining portions of the filter.

Thanks to such technical feature, air suction toward the circulating pump is avoided so that a smooth pump operation is assured (high pump stability). Since air is no longer brought to the pump suction area, the water level can be lowered, which means lower water amount per fill.

SUMMARY OF THE INVENTION

According to a first embodiment of the invention, in which the filter is a perforated or punched metal plate, for instance made of stainless steel, such filter presents one central zone and two side zones outside the circular pattern of the downwardly directed jet, such side zones having a plurality of holes with a pitch (distance between the centres of holes or perforation) smaller than the pitch of holes in the central zone.

According to a second embodiment of the invention, in which the filter is made of polymeric material, such filter presents a substantially circular zone, corresponding to the circular pattern of the downwardly directed jet, with no hole or perforation.

BRIEF DESCRIPTION OF THE DRAWINGS

The invention will be further described by way of non-limiting example with reference to the accompanying drawing in which.

DETAILED DESCRIPTION

Figure 1:
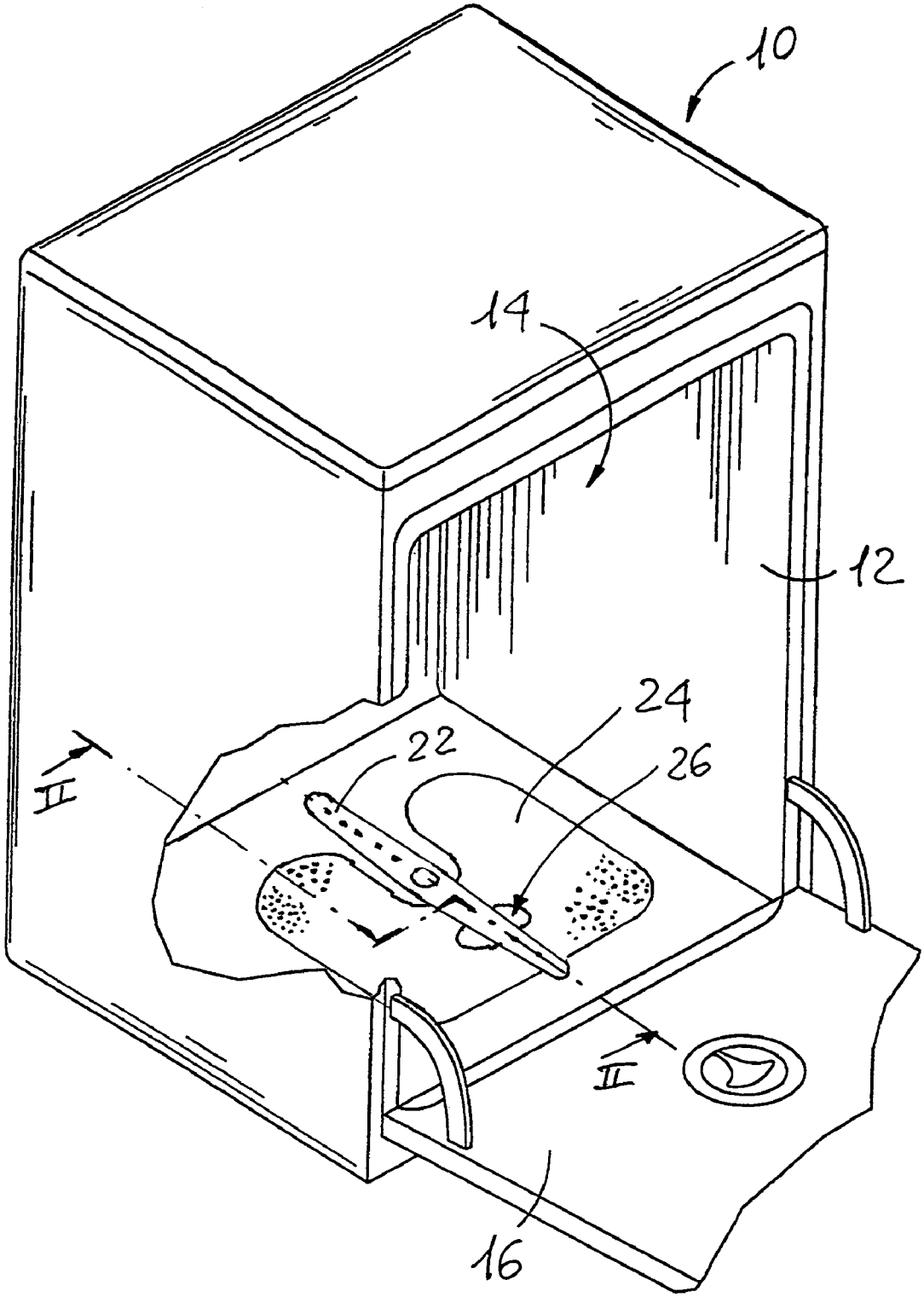
FIG. 1 is a perspective view of a dishwasher according to the invention.
Figure 2:
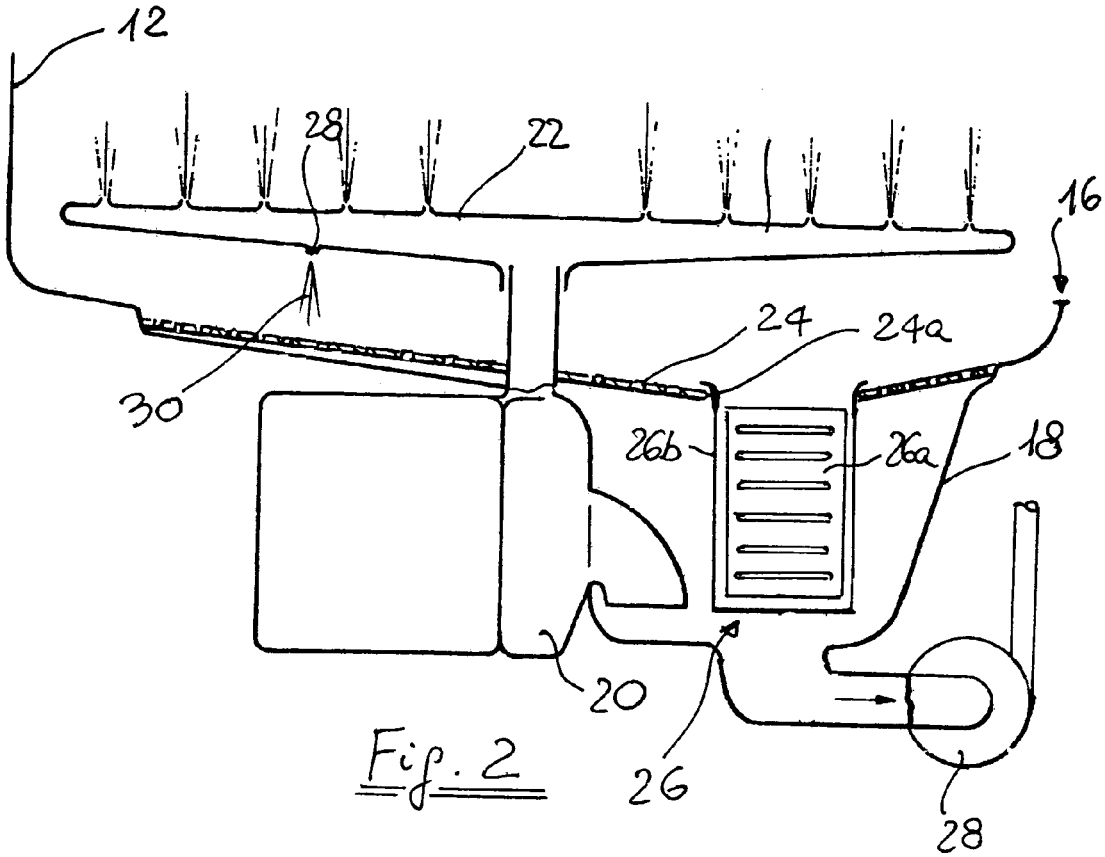
FIG. 2 is a section along line II-II of FIG. 1.

Referring to FIG. 1, a dishwasher 10 comprises a washing tank 12 provided with a front opening 14 which can be closed by a pivoting door 16. The washing tank 12 is provided at the bottom thereof with a chamber 18 (FIG. 2) for collecting the washing and rinsing water. Disposed in the chamber 18 is a circulating pump 20 which is capable of feeding at least one rotary arm 22 for spraying the crockery to be washed in a known manner. The bottom of washing tank 12 houses a fine-mesh filter 24 disposed in the path of flow of the water which, after having sprayed over the crockery, is collected in the chamber 18 and is drawn in again by the circulating pump 20. The filter 24 is substantially flat and, in its working configuration, substantially horizontal. It is provided with a circular aperture 24*a* in which a pump-protecting cylindrical filter assembly 26 is removably disposed, such assembly being disposed in the path of flow of the water which is drawn in by a discharge pump 28 from the chamber 18. The cylindrical filter assembly comprises a wide-mesh basket 26*a* inserted in a micro-filter casing 26*b*. Such two components of the assembly 26 can be easily removed from each other so that the user can clean them.

Provided on the underneath side of the arm 22 is a nozzle 28 for directing a jet of water 30 downwardly. The jet of water 30 rotates with the arm 22 and, during its rotary movement, strikes the fine-mesh horizontal filter 24 along a circular pattern P (shown in dotted line in FIGS. 3 and 4) and, intermittently, it strikes also the filter assembly 26 for providing an automatic cleaning thereof.

Figure 3:
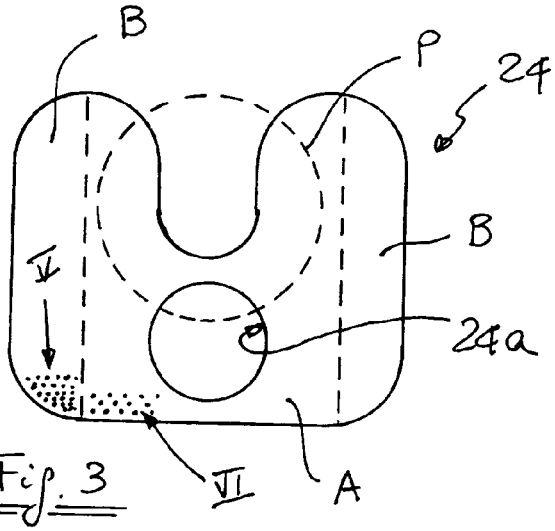
FIG. 3 is a plan view of the fine-mesh filter used in the dishwasher of FIGS. 1 and 2 according to a first embodiment of the invention.
Figure 4:
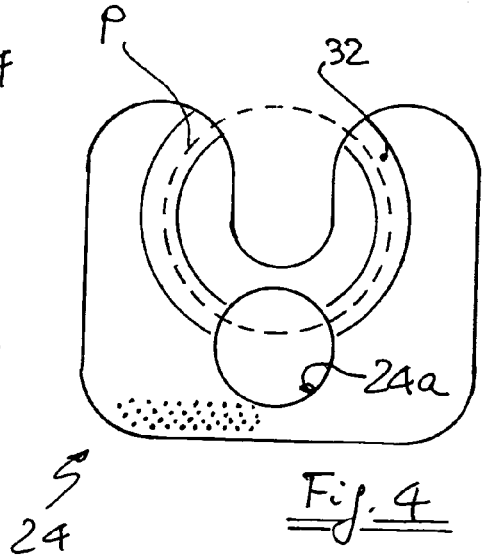
FIG. 4 is a plan view of the fine-mesh filter used in the dishwasher of FIGS. 1 and 2 according to a second embodiment of the invention.
Figure 5:
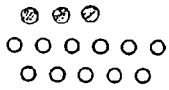
FIGS. 5 and 6 are enlarged views of different portions of FIG. 3.
Figure 6:
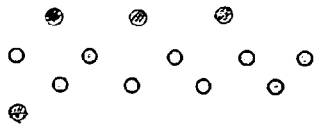

According to a first embodiment of the invention (FIG. 3), the fine-mesh filter 24 is made of punched stainless steel foil and presents a central zone A, in which the aperture 24*a* for the cylindrical filter assembly 26 is provided, and two side zones B, outside the circular pattern P of the jet of water 30. The zones A and B differ from each other in the percentage of open area. The central zone A presents holes having a diameter of 0.7-0.9 mm, preferably 0.8 mm, with a pitch so that the percentage of open area is in the range of 8% to 20%, preferably 13% to 18% (a simplified view of the punched area of zone A is shown in FIG. 6). The side zones B present holes having the same diameter of the zone A, but with a lower pitch (FIG. 5) so that the percentage of open area is in the range 20%-40%, preferably 27%-35%. Of course the same difference in percentage of open area may be obtained also by changing not only the pitch but also the diameter of the holes in the different zones. Moreover, instead of having three zones divided by straight lines as shown in FIG. 3, it would be possible to have a circular zone, in which the circular pattern P is included, in which the holes of the filter 24 have a pitch pattern similar to FIG. 6. However, the solution shown in FIG. 3, in which only the pitch of the holes changes and in which the three zones are divided by parallel straight lines, is the cheapest one in term of mass production, bearing in mind that the filters 24 are obtained starting from a coil of thin stainless steel foil which is then subjected to an automatic forming and punching process. The higher percentage of open area in the side zones B gives a higher water flow rate which allows water flow even when the rest of the screen is soiled, so that the system is able to handle more soil.

According to a second embodiment of the invention (FIG. 4), the filter 24 is obtained through an injection-moulding process of a polymeric material. In this case the pitch of the holes of the filter 24 can be maintained constant on most of the surface thereof, and a circular zone 32 is provided (corresponding to the circular pattern P of the jet of water 30) with no holes, so as to avoid the entrapment of air in the water entering the chamber 18 but maintaining a cleaning cross action of the filter 24.

I claim:

1. A dishwasher comprising a circulating pump, a washing tank provided with a substantially horizontal filter disposed in the path of the flow of water drawn in by the circulating pump, and a sprayer capable of directing downwardly at least one rotating water jet, wherein the filter presents a non-uniform percentage of open area; and the downwardly directed jet impinges substantially upon a percentage of open area lower than the other portions of the filter with other portions of the filter being outside a circular pattern of the downwardly directed jet.

2. A dishwasher according to claim 1, in which said filter is a perforated or punched plate, wherein it presents one central zone and two side zones outside the circular pattern of the downwardly directed jet, such two side zones having a percentage of open area higher than the percentage of open area of the central zone.

3. A dishwasher according to claim 2, wherein said two side zones have a plurality of holes with a pitch lower than the pitch of holes in the central zone of the filter.

4. A dishwasher according to claim 3, wherein said central zone of the filter presents a percentage of open area comprised between 8% and 20%.

5. A dishwasher according to claim 4, wherein the holes of the filter have a diameter comprised between 0.7 and 0.9 mm.

6. A dishwasher according to claim 1, wherein the filter presents a substantially circular zone, corresponding to the circular pattern of the downwardly directed jet, with no hole or perforation.

7. A dishwasher comprising:

a circulating pump;

a washing tank provided with a substantially horizontal filter disposed in a path of a flow of water drawn in by the circulating pump, the filter having holes spaced in a first zone with a first percentage open area and in a second zone with a second percentage open area, the first percentage open area being larger than the second percentage open area;

a sprayer with at least one downwardly directed water jet, wherein the water jet rotates in a circular pattern and strikes substantially upon the second zone of the filter with the first zone being outside the circular pattern of the water jet, resulting in a substantial reduction of an amount of air bubbles entrained with the water that is drawn in by the circulating pump.

8. The dishwasher according to claim 7, wherein the second zone is presented in a circular pattern.

9. The dishwasher according to claim 7, wherein the second percentage open area of the filter is presented in a central zone and the first percentage open area of the filter is presented in two side zones, the two side zones being outside the circular pattern of the downwardly directed jet.

10. The dishwasher according to claim 9, wherein the holes of the central zone have a pitch higher than the pitch of holes in the two side zones of the filter.

11. The dishwasher according to claim 9, wherein the filter is a perforated plate.

12. The dishwasher according to claim 7, wherein the second zone of the filter presents the second percentage open area between 8% and 20%.

13. The dishwasher according to claim 12, wherein the holes of the filter have a diameter comprised between 0.7 and 0.9 mm.

14. A dishwasher comprising:

a circulating pump;

a washing tank provided with a substantially horizontal filter disposed in the path of a flow of water drawn in by the circulating pump, the filter being substantially covered by a plurality of holes; and a sprayer capable of directing downwardly at least one rotating water jet, wherein the downwardly directed jet impinges substantially upon an area of the filter having a percentage of open area lower than other portions of the filter with other portions of the filter being outside the circular pattern of the water jet.

15. The dishwasher according to claim 14, wherein the area of the filter having a percentage of open area lower than other portions of the filter is substantially circular, with no hole or perforation.

16. The dishwasher according to claim 14, wherein the filter is a perforated plate having a central zone and at least one side zones, the side zone having a percentage of open area higher than the percentage of open area of the central zone.

17. The dishwasher according to claim 16, wherein the holes of the central zone have a pitch higher than the pitch of the holes in the side zone.

* * * * *